US005185959A

United States Patent [19]

Ikola et al.

[11] Patent Number: 5,185,959

[45] Date of Patent: Feb. 16, 1993

[54] APPARATUS FOR GRINDING THE EDGE OF A GLASS SHEET

[75] Inventors: Kimmo J. Ikola, Kangasala; Kimmo E. Stenman; Erkki P. J. Yli-Vakkuri, both of Tampere, all of Finland

[73] Assignee: Tamglass Oy, Tampere, Finland

[21] Appl. No.: 899,052

[22] Filed: Jun. 16, 1992

Related U.S. Application Data

[63] Continuation of Ser. No. 544,385, Jun. 27, 1990, abandoned.

[30] Foreign Application Priority Data

Mar. 29, 1990 [FI] Finland ..... 901573

[51] Int. Cl.[5] ..... B24B 15/00

[52] U.S. Cl. ..... 51/72 R; 51/283 E

[58] Field of Search ..... 51/31, 54, 72 R, 72 L, 51/98 R, 105 LG, 283 E, 284 E

[56] References Cited

U.S. PATENT DOCUMENTS

| | | | |
|---|---|---|---|
| 2,733,553 | 2/1956 | Newsom | 51/72 R |
| 2,969,620 | 1/1961 | Bretscher | 51/72 R |
| 4,492,059 | 1/1985 | Panetti | 51/72 R |
| 4,914,866 | 4/1990 | Jackson et al. | 51/72 R |
| 4,958,463 | 9/1990 | Hess et al. | 51/72 R |

FOREIGN PATENT DOCUMENTS

| | | |
|---|---|---|
| 0033922 | 3/1982 | European Pat. Off. . |
| 2127298 | 12/1972 | Fed. Rep. of Germany . |
| 7425126 | 10/1974 | Fed. Rep. of Germany . |
| 3706886 | 9/1988 | Fed. Rep. of Germany . |

*Primary Examiner*—J. J. Swann

*Attorney, Agent, or Firm*—Burns, Doane, Swecker & Mathis

[57] ABSTRACT

A grinding wheel for grinding the edges of glass sheets is mounted on a vertically adjustable drive shaft. The drive shaft is rotated by a motor and is raised and lowered by a pneumatic cylinder. Vertical movement of the drive shaft occurs relative to the motor. The pneumatic cylinder is coupled to the drive shaft by a rotary joint, and the vertical limits of movement of the shaft are defined by two vertically adjustable stops. Vertical movement of the drive shaft occurs relative to the motor. By raising and lowering the grinding wheel between the two stops, the apparatus can grind the edges of glass sheets having different thicknesses.

10 Claims, 2 Drawing Sheets

APPARATUS FOR GRINDING THE EDGE OF A GLASS SHEET

This application is a continuation of application Ser. No. 07/544,385, filed Jun. 27, 1990, now abandoned.

BACKGROUND OF THE INVENTION

The present invention relates to an apparatus for grinding the edge of a glass sheet, said apparatus comprising a substantially horizontal glass sheet carrying table, a rotatable drive shaft, a grindstone attached to the drive shaft and having its periphery formed with one or more V- or U-shaped grooves, the grindstone being adapted for vertical movement relative to the plane of the carrying table. This type of apparatus is known e.g. from DE Patent publications 2 127 298 and 3 706 886. In the latter, a grindstone along with its driving motor is vertically movable, whereby the masses to be moved are great and the adjustment accuracy suffers. On the other hand, in Patent publication DE 2 127 298 a glass sheet is supported between ball-coated plates and the plates are adjustable relative to a framework. Also in this case the adjustment necessarily involves the movement of great masses and the adjustment is slow and tedious to perform.

An object of the invention is to provide an apparatus adapted for the vertical adjustment of a grindstone, wherein the masses to be moved are small and which provides for a high adjustment precision and whereby the adjusting movements can be performed readily and quickly.

BRIEF DESCRIPTION OF THE DRAWINGS

One embodiment of the invention will now be described in more detail with reference made to the accompanying drawings, in which.

DETAILED DESCRIPTION OF A PREFERRED EMBODIMENT OF THE INVENTION

Figure 1:
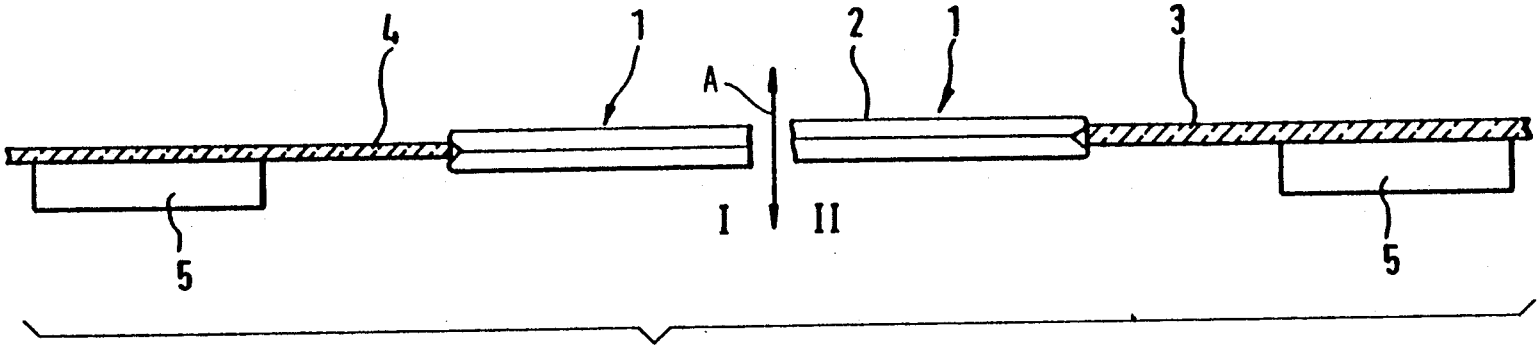
FIG. 1 PRIOR ART
FIG. 1 is a schematic side view of a conventional single-groove grindstone showing two vertical positions thereof for grinding two glass sheets of different thicknesses.

Referring to FIG. 1, reference numeral 1 designates a conventional grindstone having its periphery provided with a V-shaped grinding groove 2. A glass sheet 3 or 4 is carried on a table 5 which is stationary in vertical direction. Only one of those sheets 3, 4 would be ground in a given grinding operation; the grindstone would be vertically adjusted along a vertical axis A to align the grindstone with an edge of the other glass sheet to perform a grinding operation thereon. Thus, by displacing grindstone 1 in a vertical direction, the plane of symmetry of grinding groove is aligned with the centre line of the edge of glass sheet 3 or 4. Then, relative horizontal movement is effected between the grindstone and the glass sheet 3 or 4, e.g., by moving grindstone 1 in a horizontal direction until the rim edges of glass sheet 3 or 4 come to contact with the flanks of grinding groove 2. Grindstone 1 is rotated around the vertical axis while moving it along the edge of glass sheet 3 or 4. Alternatively the table could be moved in a horizontal direction. As grindstone 1 is rotating, the sharp edges of glass sheet 3 or 4 are being symmetrically ground. The thickness of glass sheet 4 is e.g. 2 mm and the thickness of glass sheet e.g. 2.5 mm.

As one glass sheet 3 is replaced by a glass sheet 4 of different thickness, a grindstone 1 is moved in the vertical direction, i.e. in the direction orthogonal to the plane of the glass sheet, either upwards to an upper position II or downwards to a lower position I depending on whether the new glass sheet is thicker or thinner than the previous sheet. At each of positions I and II the grindstone 1 is placed on a level for bringing its grinding groove 2 symmetrically into contact with the side edges of glass sheet 3 or 4. The necessary vertical shifting distance for a glass sheet is half of the difference in grindstone in order to adjust for a new sheet of different thickness equals half of the difference between the thicknesses of the two glass sheets, e.g., in this case $(2.5-2.0)/2=0.25$ mm.

Figure 2:
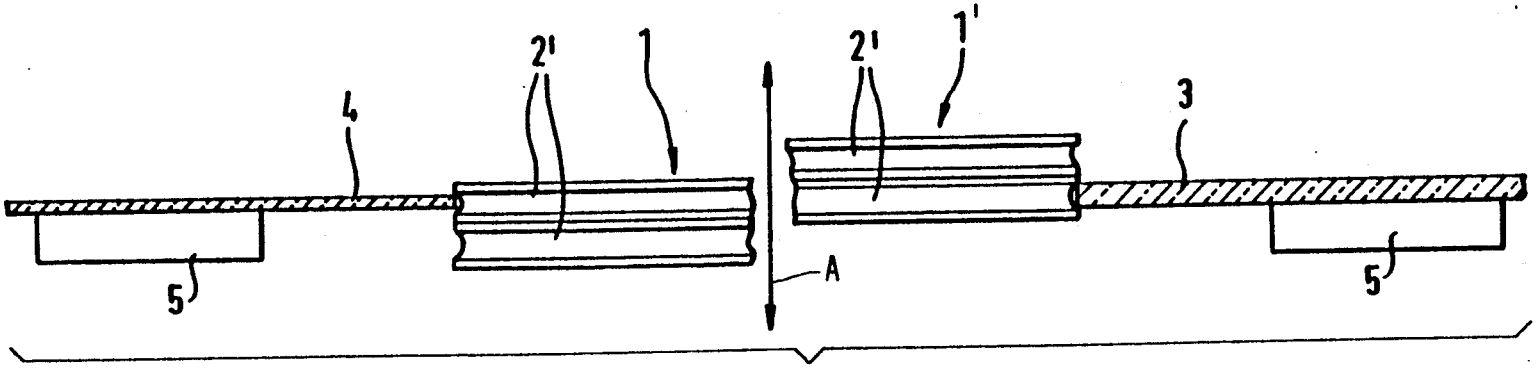
FIG. 2 PRIOR ART
FIG. 2 is a view similar to FIG. 1 in conjunction with a conventional double-groove grindstone.

In FIG. 2, the same components are indicated by the same reference numerals as in FIG. 1. The apparatus of FIG. 2 differs from FIG. 1 in that grindstone 1 is provided with two grinding grooves 2' which are U-shaped. The narrower groove 2' can be used for form grinding the edge of thinner glass sheets 4 and the wider groove 2' is used for form grinding the edge of a thicker glass sheet 3. Thus, the shape and number of grinding grooves in grindstone 1' can vary.

Figure 3:
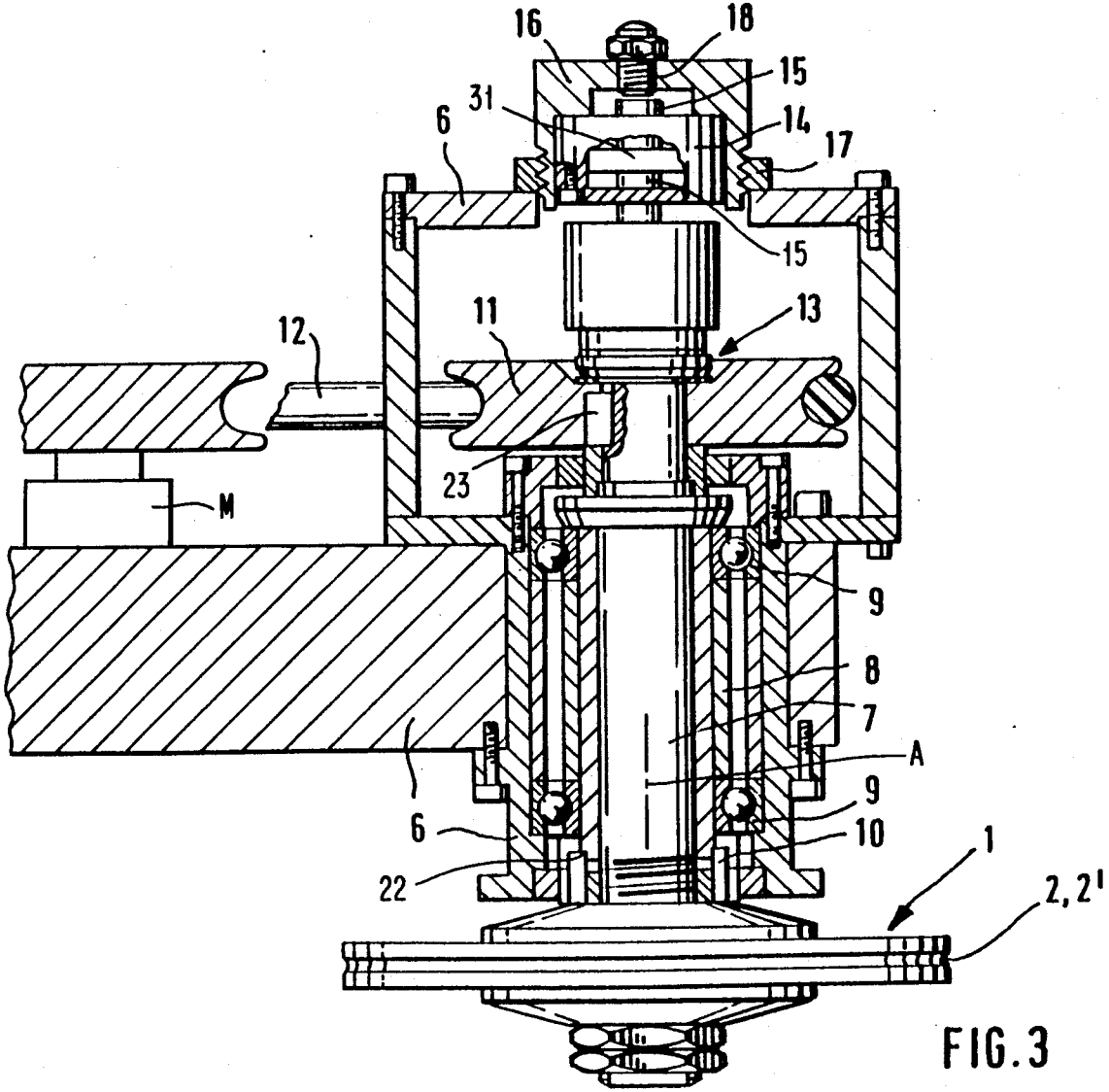
FIG. 3 is a vertical section of an apparatus of the invention.
Figure 4:
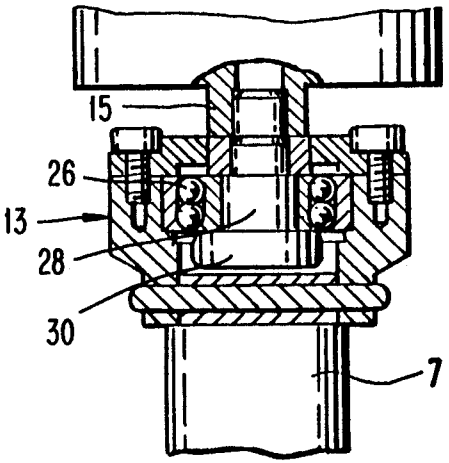
FIG. 4 is a vertical section of an enlarged detail of FIG. 3.

In accordance with the present invention, the shifting of grindstone 1 in the vertical direction is effected by only shifting grindstone 1 and its driving shaft 7, as explained in more detail hereinafter with reference to FIGS. 3 and 4. Grindstone 1 is secured to the bottom end of driving shaft 7. Drive shaft 7 is journalled to a frame body 6 through the intermediary of a tubular axle 8 by means of bearings 9. The tubular axle is thus rotatable relative to the body 6 about a vertical axis A. The drive shaft is vertically movable relative to the tubular shaft along the vertical axis A. The rotating motion of drive shaft 7 is transmitted tubular axle 8 by means of torque rods 10 which are carried by the grindstone and are slidably engaged in recesses 22 formed in the axle 8 to permit the axial movement of drive shaft 7 and its associated grindstone 1 relative to tubular axle 8. The top end of drive shaft 7 is fitted with a belt pulley 11 rotated by a drive motor (M) through the intermediary of a belt 12. The belt pulley is connected to the shaft 7 by a spline 23 to permit vertical movement of the shaft 7.

The top end of drive shaft 7 is connected through the intermediary of a rotary joint 13 to a piston rod 15 of a pneumatic fluid cylinder/piston device. The rotary joint 13 includes a bearing 26 which permits the drive shaft 7 to rotate relative to the piston rod 15 about axis A. A fastener 28 connected to the lower end of the piston rod 15 includes an enlarged head 30 which underlies the bearing 26. Thus, by raising the piston rod 15, the head 30 will raise the drive shaft 7. The cylinder/piston device comprises a cylinder 14 in which a piston 31 is vertically movable under the action of pneumatic pressure. The piston rod 15 extends downwardly from the piston through the pneumatic cylinder 14. Pneumatic cylinder 14 is fitted in a bowl-shaped member 16 which is fastened to frame body 6 by means of its external thread attached to a rotary nut 17. The base of bowl-shaped member 16 is provided with a set screw 18 which limits the upward movement of the piston of cylinder 14 by hitting the top end of an upwardly extending portion of piston rod 15. Thus, a lower wall of the internal piston chamber of the cylinder 14 constitutes an adjustable lower stop for the piston rod 15 for defining the lower position of the grindstone 1, and the screw 18 constitutes an adjustable upper stop for the piston rod 15 for defining the upper position of the grindstone 1.

For example, when grinding glass according to stages I and II in FIG. 1, the operation of adjusting means proceeds as follows:

1) for 2.0 mm glass the position I of grindstone 1 is effected by adjusting the cylinder 14 via nut 17 (lower position adjustment)
2) for 2.5 mm glass the position II of grindstone 1 is effected by adjusting the screw 18 (upper position adjustment)
3) pneumatic cylinder 14 is used to shift grindstone 1 from position I to position II relative to the motor M. In position I the piston engages the base of the piston chamber of the cylinder 14 and in position II piston rod 15 engages screw 18.

It can be appreciated from the above that the upper and lower position of a grindstone can be adjusted at high precision and, after completing the adjustment, the grindstone can be shifted rapidly and automatically between positions I and II. For example, the vertical adjustment of grindstone 1 provided with a single groove 2 can correspond to a setting range from 1.5 mm glass thickness to 6 mm thickness, in which case the adjustment distance of the grindstone is $(6-1.5)/2=2.25$ mm. Such a small adjustment distance can be readily achieved with the apparatus shown in FIG. 3. A corresponding structural design, with slightly modified dimensions, can also be used for fulfilling the adjustment requirement shown in FIG. 2.

We claim:

1. Apparatus for grinding an edge of a glass sheet, comprising:

a substantially horizontal table for carrying a glass sheet;

a frame;

a vertically extending tubular axle rotatably journaled to said frame for rotation about a substantially vertical axis;

a drive shaft mounted coaxially within said axle for rotation therewith and for up-and-down axial movement relative thereto;

a grinding wheel mounted to a lower end of said drive shaft for rotation therewith and including an outer peripheral edge having at least one circumferentially extending groove therein for grinding an edge of a glass sheet supported on said table;

a motor operably connected to said drive shaft for rotating said drive shaft and said grinding wheel about said axis; and raising and lowering means disposed above, and aligned with, said drive shaft for moving said drive shaft along said axis for adjusting the elevation of said grinding wheel between an upper first position and a lower second position for grinding glass sheets of different thicknesses, said raising and lowering means including:

an adjustment member mounted to an upper end of said drive shaft by a rotary joint such that said drive shaft is rotatable relative to said adjustment member and is movable therewith along said axis, and first and second independently vertically adjustable stop means for terminating the movement of said adjustment member at upper and lower limits, respectively, along said axis to define said upper first position and said lower second position, respectively, of said grinding wheel.

2. Apparatus according to claim 1, wherein said drive shaft is movable relative to said motor along said axis.

3. Apparatus according to claim 1, wherein said raising and lowering means comprises a fluid cylinder and piston assembly mounted on said frame above said drive shaft, said piston defining said adjustment member and carrying a downwardly extending piston rod connected to said rotary joint, said cylinder being vertically adjustably movable relative to said frame and defining said second stop means.

4. Apparatus according to claim 3 including an inverted bowl-shaped member mounted on said frame for vertical adjustment relative thereto; said cylinder being affixed within said bowl-shaped member for vertical movement therewith.

5. Apparatus according to claim 4 including an upwardly extending piston rod carried by said piston, said first stop means comprising a vertically adjustable pin carried by said bowl-shaped member and positioned to be contacted by said upwardly extending piston rod.

6. Apparatus for grinding an edge of a glass sheet, comprising:

a substantially horizontal table for carrying a glass sheet;

a frame;

a drive shaft mounted to said frame for rotation about a substantially vertical axis and for up-and-down movement relative to said frame along said axis;

a grinding wheel mounted to a lower end of said drive shaft for rotation therewith and including an outer peripheral edge having at least one circumferentially extending groove therein for grinding an edge of a glass sheet supported on said table;

a motor operably connected to said drive shaft for rotating said drive shaft and said grinding wheel about said axis; and raising and lowering means for moving said drive shaft along said axis relative to said motor for adjusting the elevation of said grinding wheel between an upper position and a lower second position for grinding glass sheets of different thicknesses, said raising and lowering means including:

an adjustment member mounted to an upper end of said drive shaft by a rotary joint such that said drive shaft is rotatable relative to said adjustment member and is movable therewith along said axis, and first and second independently vertically adjustable stop means for terminating the movement of said adjustment member between upper and lower limits, respectively, along said axis to define said upper first position and said lower second position, respectively, of said grinding wheel.

7. Apparatus according to claim 6, wherein said raising and lowering means is aligned with said axis.

8. Apparatus according to claim 7, wherein said raising and lowering means comprises a fluid cylinder and piston assembly mounted on said frame above said shaft, said piston defining said adjustment member and carrying a downwardly extending piston rod aligned with said drive shaft and connected to said rotary joint, said cylinder being vertically adjustably movable relative to said frame and defining said second stop means.

9. Apparatus according to claim 8 including an inverted bowl-shaped member mounted on said frame for vertical adjustment relative thereto; said cylinder being affixed within said bowl-shaped member for vertical movement therewith.

10. Apparatus according to claim 9 including an upwardly extending piston rod carried by said piston, said first stop means comprising a vertically adjustable pin carried by said bowl-shaped member and positioned to be contacted by said upwardly extending piston rod.

* * * * *